US009660382B2

(12) United States Patent
Beaty et al.

(10) Patent No.: US 9,660,382 B2
(45) Date of Patent: May 23, 2017

(54) ELECTRICAL EXTENSION CORD WITH A UNITARY AND CONVERTIBLE TWO OR THREE PRONG PLUG END

(71) Applicants: Cleodis Beaty, Rochester, NY (US); Germaine Beaty, Rochester, NY (US)

(72) Inventors: Cleodis Beaty, Rochester, NY (US); Germaine Beaty, Rochester, NY (US)

( * ) Notice: Subject to any disclaimer, the term of this patent is extended or adjusted under 35 U.S.C. 154(b) by 0 days.

(21) Appl. No.: 14/876,220

(22) Filed: Oct. 6, 2015

(65) Prior Publication Data

US 2017/0098910 A1 Apr. 6, 2017

(51) Int. Cl.
*H01R 4/66* (2006.01)
*H01R 13/642* (2006.01)

(52) U.S. Cl.
CPC ..... *H01R 13/642* (2013.01)

(58) Field of Classification Search
CPC ..... H01R 27/00; H01R 29/00; H01R 35/04
USPC ..... 439/104, 103
See application file for complete search history.

(56) References Cited

U.S. PATENT DOCUMENTS 5,234,360 A * 8/1993 Kramer, Jr. ..... H01R 25/003 439/367
7,144,266 B2 * 12/2006 Bhutani ..... H01R 35/04 439/352

* cited by examiner

*Primary Examiner* — Phuong Dinh
(74) *Attorney, Agent, or Firm* — Woods Oviat Gilman LLP; Katherine H. McGuire, Esq.

(57) ABSTRACT

What is presented is an extension cord with a convertible electrical plug end that can be connected to grounded and ungrounded power supply outlets. The extension cord comprises an extension cord and a plug end and is configured to transmit electrical power. The plug end is connected to the extension cord. The plug end itself comprises a plug body, plurality of prongs, flap, and ground contact. The protruding prongs are connected to the plug body and configured to couple to the outlet. The flap is movably attached to the plug body such that the flap can rotate relative to the plug body. When the flap is in the closed position, the plug end can connect to a grounded outlet. The ground contact is configured to releasably and electrically connect the extension cord to a ground potential on the outlet.

6 Claims, 2 Drawing Sheets

ELECTRICAL EXTENSION CORD WITH A UNITARY AND CONVERTIBLE TWO OR THREE PRONG PLUG END

BACKGROUND OF THE INVENTION

The present invention relates to an electrical extension cord, and more particularly relates to an extension cord that has a convertible electrical plug end that can connect with both grounded and ungrounded power supply outlets.

Electrical extension cords are well known to connect the power cords of appliances to an electricity supply via a wall socket or additional extension cord. They are generally light-weight and consist of a length of insulated wire. They can be used with a variety of appliances that range from simple devices, such as floor lamps, to complex electronic apparatuses, such as refrigerators and computers. Certain power cords of these appliances incorporate a third prong ("ground prong"), which electrically connects the appliance's chassis to the wall socket or additional extension cord. In some instances, these grounded power cords must be connected to an "ungrounded" outlet of an electricity supply. This requires a device that can connect an appliance's grounded power cord to an outlet lacking a grounding socket. In the past, plug adapters (otherwise known as "cheater plugs") made it possible to plug the grounded power cord into an ungrounded outlet. However, these cheater plugs are independent from the extension cord as well as clunky and easily lost. As such, there remains a need for an improved device that makes it possible to plug the grounded power cord into an ungrounded outlet which overcomes the draw backs of cheater plugs.

SUMMARY OF THE INVENTION

The present invention relates to an extension cord. More particularly, in one aspect, the invention comprises an extension cord with a convertible electrical plug end that can be connected to grounded and ungrounded power supply outlets. The extension cord comprises an extension cord and a plug end and is configured to transmit electrical power. The plug end is connected to the extension cord. The plug end itself comprises a plug body, plurality of prongs, flap, and ground contact. The protruding prongs are connected to the plug body and configured to couple to the outlet. The flap is movably attached to the plug body such that the flap can rotate relative to the plug body. When the flap is in the closed position, the plug end can connect to a grounded outlet. The ground contact is configured to releasably and electrically connect the extension cord to a ground potential on the outlet.

In another embodiment of the invention, the extension cord comprises a socket end, which is located on the opposite end of the extension cord from the plug end. This socket end comprises a plurality of orifices that are configured to electrically connect the power cord of an appliance to the outlet. In certain instances, the socket end comprises a third orifice configured to transmit electrical power from the appliance to ground via the outlet.

In another embodiment of the invention, the ground contact is positioned on the flap. In this embodiment, the extension cord comprises a second ground contact positioned on the plug body. The second ground contact may be releasably connected to the ground contact. When the ground contact and second ground contact are releasably connected, the electric cord may be grounded. In certain instances, the flap may comprise a plurality of openings configured to facilitate the flap being in the closed position. In other instances, the flap may comprise a third prong connected to the second ground contact. This third prong is configured to transmit electrical power to ground via the outlet.

In certain instances, the plurality of prongs comprises a first prong configured to couple to the positive terminal of the outlet, and a second prong configured to couple to the negative terminal of the outlet. These prongs may be plated with a material to prevent corrosion. In certain instances, the extension cord and the plug end are made from any non-conductive material that is suitably light and rigid. In certain instances, the ground contact is plated with a material to prevent corrosion.

Numerous applications, some of which are exemplarily described below, may be implemented using the present invention.

DETAILED DESCRIPTION OF PREFERRED EMBODIMENTS

Figure 1:
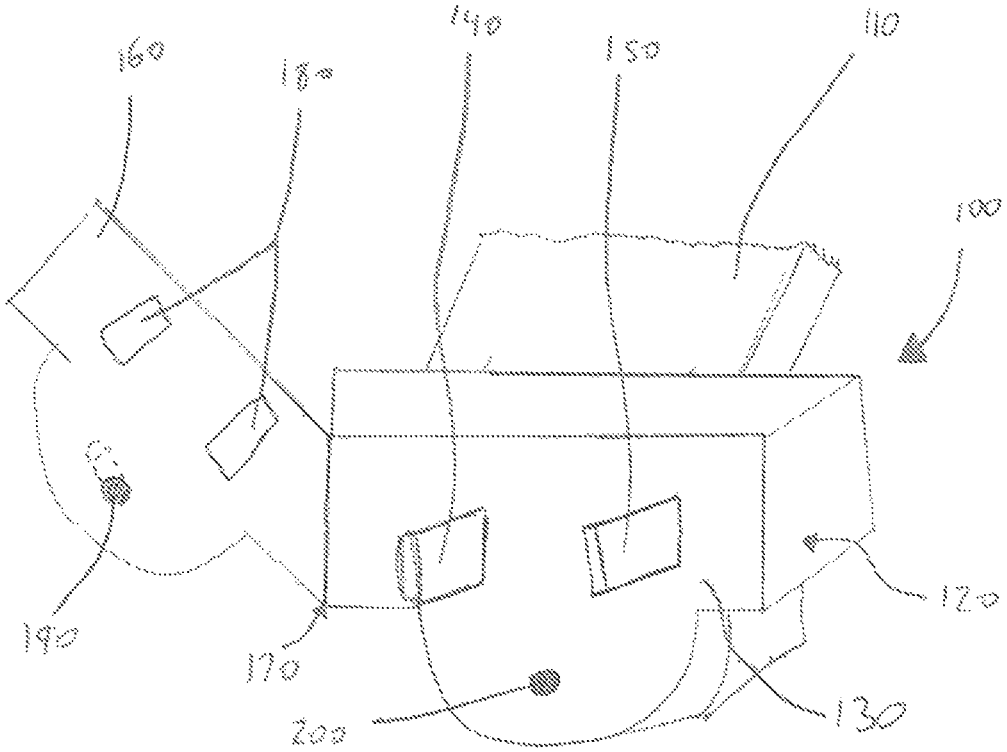
FIG. 1 is a perspective view of an embodiment of the invention.

Referring to the drawings in detail, and specifically to FIG. 1, reference numeral 100 generally designates an exemplary unitary and convertible two or three prong plug connector ("plug end") in accordance with an embodiment of the present invention. The plug end 100 is generally configured to makes it possible to connect a grounded power cord (not shown) into an outlet without a grounding socket (not shown). The plug end 100 includes a plug body 130 with multiple protruding prongs 140, 150. The prongs may include a first prong 140 and a second prong 150 and each may be coupled to an outlet for an electricity supply. The first prong 140 may be extended to couple to a positive terminal of the outlet, and the second prong 150 may be extended to couple to a negative terminal of the outlet. The prongs 140, 150 may be made of brass, copper, or a similar electrically conductive material, and may be plated with a material to prevent corrosion, such as nickel. While only two prongs are shown, embodiments of the invention may have a greater or lesser number of prongs depending on the configuration of the outlet to which the plug end is intended to be coupled. The shape and design of the prongs may also vary depending on the configuration of the outlet.

Attached to the plug body 130 is an extension cord 110 through which electrical power may be transmitted (AC voltage or DC voltage). In this way, electrical power may be received at the prongs 140, 150 and transmitted to an appliance that is coupled to a receptacle socket (shown in FIG. 3). The extension cord 110 may be from around a few inches to many feet in length and come in various colors, lengths, thicknesses, and service duties. The extension cord may also be made from a number of electrical conducting wires (not shown) encapsulated in an insulating material (not shown). To this extent, the prongs 140, 150 may be electrically coupled to two of these conductive wires. The plug body 130 and insulating material may be made of any non-conductive material that is suitably light and rigid, and may be used outdoors, in wet areas, around oils, or exposed to sunlight for long periods.

Movably attached to the plug body 130 is a flap 160, which is made from the same material as both the plug body 130 and insulating material. The flap 160 may be attached to the body 130 via a living hinge 170 that allows the rigid flap 160 to rotate relative the plug body 130 about the fixed line forming the hinge 170. Embodiments of the invention may also incorporate hinges other than the living hinge 170 or may incorporate any other device that enables the flap 160 to move relative the plug body 130.

When the prongs 140, 150 are coupled to an outlet, the flap 160 could be in either the open or closed position. A user may place the flap 160 in the closed position when attempting use the extension cord 110 to connect a power cord to a grounded outlet. While in the closed position, the flap 160 is situated between the outlet and plug body 130. This forces the flap 160 to remain stationary and abutted directly against the plug body 130. A user may place the flap 160 in the open position when attempting use the extension cord 110 to connect a power cord to an outlet lacking a grounding socket. While in the open position, the flap 160 is suspended away from the outlet. This forces the flap 160 to remain entirely out of the way of the connection between the outlet and plug body 130.

The flap 160 is constructed such that multiple openings 180 allow the prongs 140, 150 to protrude through the flap 160 when in the closed position. A first ground contact 190 may be positioned on the flap 160 and may press against the plug body 130 of the plug end 100. When against the plug body 130, the first ground contact 190 may be releasably and electrically connected with a second ground contact 200. This allows for a third prong (shown in FIG. 2) to be coupled into a ground potential, such as a grounding socket of the outlet, and in turn grounded. When the flap 160 is in the open position, the second ground contact 200 may be releasably and electrically connected with another ground potential, such as a screw on the face of the outlet, and in turn grounded. In certain embodiments, a clip or other locking mechanism (not shown) may be incorporated to ensure the flap 160 remains stationary and abutted directly against the plug body 130, when in the closed position. The ground contacts 190, 200 may be made of brass, copper, or a similar electrically conductive material, and may be plated with a material to prevent corrosion, such as nickel. Moreover, while two openings 180 are shown, embodiments of the invention may have a greater or lesser number of openings 180, depending on the number and design of the prongs to which the plug end incorporates.

Figure 2:
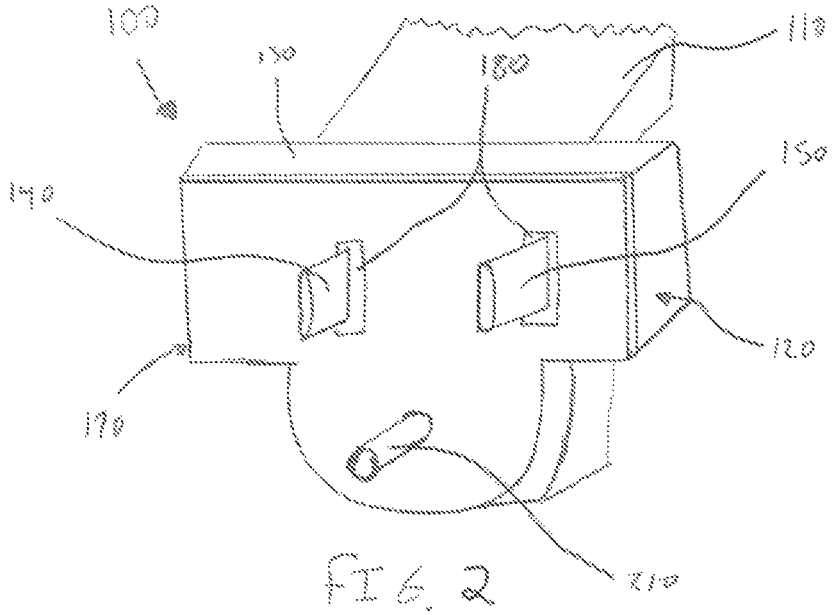
FIG. 2 is a perspective side view of the embodiment of the invention of FIG. 1 with a flap in a closed position.

Turning now to FIG. 2, when the flap 160 is in the closed position, the third prong 210 may extend away from the plug body 130 of the plug end 120 and be parallel with the other prongs 140, 150. This allows the third prong 210 be in contact with or proximate to the outlet. The third prong 210 may be configured to be coupled to a ground potential, as stated above, and to a conductive wire in the extension cord 110. In this way, the third prong 210 may transmit any electrical power to ground via the outlet. The third prong 210 may be made of brass, copper, or a similar electrically conductive material, and may be plated with a material to prevent corrosion, such as nickel. The shape and design of the third prong 210 may also vary depending on the configuration of the outlet.

Figure 3:
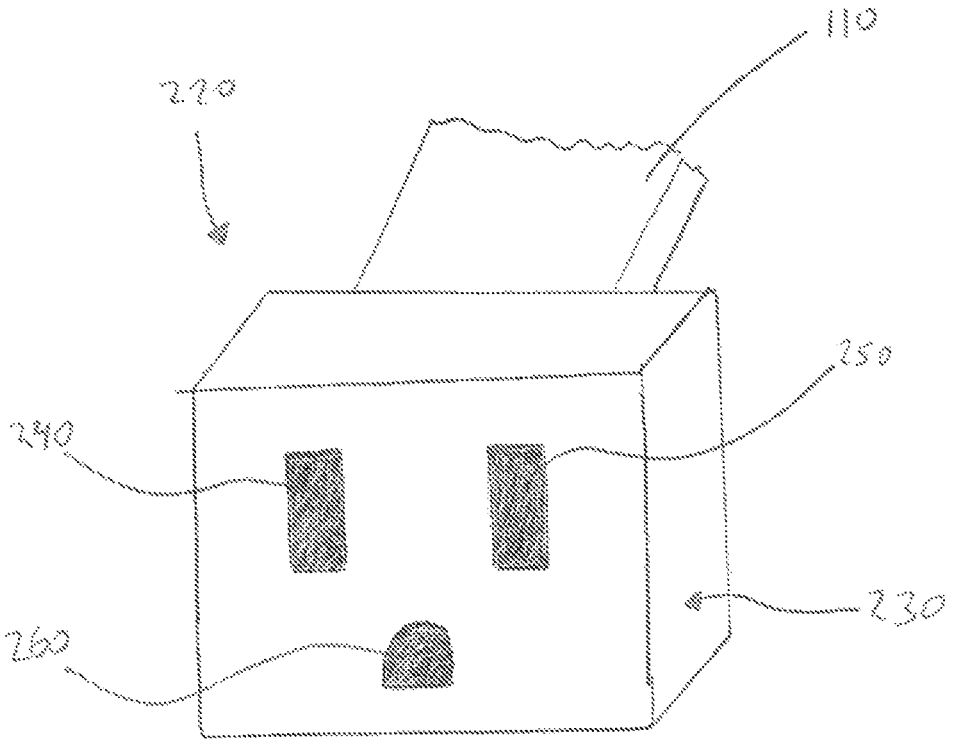
FIG. 3 is a perspective view of the receptacle socket of the extension cord in which an embodiment of the invention is connected.

As shown in FIG. 3, reference numeral 100 generally designates an exemplary receptacle socket 220 ("socket end"), which is found at the exact opposite end of the extension cord 110 from the plug end 100. Similar to the plug end 100, the socket end 220 is generally configured to makes it possible to connect a grounded power cord into an outlet without a grounding socket. However, it should be understood that an ungrounded power cord may also be connected to the socket end 220. To this extent, any power cord may couple with the socket end 220 such that the appliance may receive electric power from the outlet.

The socket end 220 includes a socket body 230 with multiple socket orifices 240, 250, and 260. The socket body 230 may be made of any non-conductive material that is suitably light and rigid, and may be used outdoors, in wet areas, around oils, or exposed to sunlight for long periods. Attached to the socket body 230 is the extension cord 110 through which electrical power is transmitted, discussed above.

The orifices may include a first orifice 230 and a second orifice 240, both of which may be coupled to the prongs of an appliance's power cord. The orifices 230, 240 may be electrically coupled to the conductive wires in the extension cord 110 that are electrically coupled to the prongs 140, 150, discussed above. In this way, electrical power may be transmitted directly to the appliance via these orifices 230, 240. A third orifice 250 may be configured to be coupled to the ground potential via the conductive wire in the extension cord 110 electrically coupled to the third prong 210, discussed above. In this way, the third orifice 250 may transmit electrical power from the appliance to ground. Embodiments of the invention may have a greater or lesser number of orifices depending on the configuration of the power cord to which the socket end is intended to be coupled. The shape and design of the orifices may also vary depending on the configuration of the outlet.

Although the invention has been described with reference to preferred embodiments thereof, it is understood that various modifications may be made thereto without departing from the full spirit and scope of the invention as defined by the claims which follow.

What is claimed is:

1. An extension cord having a convertible electrical plug end connectable to both a grounded and ungrounded power supply outlet, said extension cord comprising:

a. an extension cord configured to transmit electrical power; and b. a plug end connected to said extension cord, said plug end comprising:

i. a plug body including a plug body ground contact;

ii. a plurality of protruding prongs connected to said plug body, said prongs configured to couple to the outlet;

iii. a flap movably attached to said plug body such that said flap rotates relative to said plug body between a closed position and an open position; and iv. a flap ground contact mounted on the flap and configured to be placed in releasable contact with the plug body ground contact when the flap is in the closed position, wherein when said flap is in the closed position, said plug end is connectable to the grounded power supply outlet, and wherein when said flap is in the open position, said plug end is connectable to the ungrounded power supply outlet.

2. The extension cord of claim 1 wherein said flap comprises a plurality of openings configured to facilitate said flap being in the closed position.

3. The extension cord of claim 1 wherein said flap further comprises a flap prong connected to said flap ground contact, said flap prong configured to transmit electrical power to ground via the grounded power supply outlet.

4. The extension cord of claim 1 wherein said plurality of prongs comprises:

a. a first prong configured to couple to a positive terminal of either said grounded power supply outlet or said ungrounded power supply outlet; and b. a second prong configured to couple to a negative terminal of either said grounded power supply outlet or said ungrounded power supply outlet.

5. The extension cord of claim 1 wherein said plurality of prongs are plated with a material to prevent corrosion.

6. The extension cord of claim 1 wherein one or both of said flap ground contact and said plug body ground contact is plated with a material to prevent corrosion.

* * * * *